US008578902B2

(12) United States Patent
Permuy et al.

(10) Patent No.: US 8,578,902 B2
(45) Date of Patent: Nov. 12, 2013

(54) CORONA IGNITION WITH SELF-TUNING POWER AMPLIFIER

(75) Inventors: Alfred Permuy, Rueil-Malmaison (FR); Keith Hampton, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 788 days.

(21) Appl. No.: 12/777,105

(22) Filed: May 10, 2010

(65) Prior Publication Data

US 2010/0282198 A1 Nov. 11, 2010

Related U.S. Application Data

(60) Provisional application No. 61/298,442, filed on Jan. 26, 2010, provisional application No. 61/176,614, filed on May 8, 2009.

(51) Int. Cl.
*F02P 23/00* (2006.01)
*H01T 19/00* (2006.01)

(52) U.S. Cl.
USPC ..... 123/143 B

(58) Field of Classification Search
USPC ..... 123/143 B
See application file for complete search history.

(56) References Cited

U.S. PATENT DOCUMENTS 5,179,928 A 1/1993 Cour et al.
5,361,737 A * 11/1994 Smith et al. ..... 123/143 B
5,636,620 A 6/1997 Kiess et al.
5,649,507 A * 7/1997 Gregoire et al. ..... 123/143 B
6,883,507 B2 4/2005 Freen
7,202,747 B2 4/2007 Forse et al.
2004/0129241 A1* 7/2004 Freen ..... 123/143 B
2005/0208442 A1 9/2005 Heiligers et al.
2009/0194051 A1* 8/2009 Smith et al. ..... 123/143 B
2010/0282197 A1* 11/2010 Permuy et al. ..... 123/143 B
2011/0146607 A1* 6/2011 Smith et al. ..... 123/143 B
2011/0175691 A1* 7/2011 Smith et al. ..... 333/222
2011/0197865 A1* 8/2011 Hampton ..... 123/623
2012/0055455 A1 3/2012 Ruan et al.

FOREIGN PATENT DOCUMENTS

FR 2859831 A1 3/2005
WO 2007135584 A1 11/2007

* cited by examiner

*Primary Examiner* — Erick Solis
(74) *Attorney, Agent, or Firm* — Robert L. Stearns; Dickinson Wright, PLLC

(57) ABSTRACT

A power amplifier circuit that has an inductor and capacitor connected to one end of the output winding of an RF transformer. The other end of the output winding is connected to a resistor that in turn is connected to ground. The transformer has two primary windings. Both primary windings have one end connected to a variable DC voltage supply. The other end of each primary winding is attached to a switch, such as a MOSFET. All three windings are wound around a core. Current flowing from the DC voltage supply to the switches causes a magnetic flux in the core. A voltage is generated on the secondary winding resistor. This voltage is fed back to the switches, controlling on and off timing. In this way the need to measure and record natural frequency is eliminated.

7 Claims, 3 Drawing Sheets

CORONA IGNITION WITH SELF-TUNING POWER AMPLIFIER

CLAIM FOR PRIORITY

This application claims the benefit of priority to U.S. provisional application No. 61/298,442, which was filed Jan. 26, 2010, and U.S. provisional application No. 61/176,614, which was filed May 8, 2009, wherein the contents of both which are hereby incorporated by reference.

BACKGROUND OF THE INVENTION

1. Technical Field

This invention relates generally to ignitors used for igniting air/fuel mixtures in automotive application and the like, and in particular to a self-tuning power amplifier for use in a corona ignition system.

2. Related Art

U.S. Pat. No. 6,883,507 discloses an ignitor for use in a corona discharge air/fuel ignition system. According to an exemplary method used to initiate combustion, an electrode is charged to a high, radio frequency ("RF") voltage potential to create a strong RF electric field in the combustion chamber. The strong electric field in turn causes a portion of the fuel-air mixture in the combustion chamber to ionize. The process of ionizing the fuel-air gas can be the commencement of dielectric breakdown. But the electric field can be dynamically controlled so that the dielectric breakdown does not proceed to the level of an electron avalanche which would result in a plasma being formed and an electric arc being struck from the electrode to the grounded cylinder walls or piston. The electric field is maintained at a level where only a portion of the fuel-air gas is ionized—a portion insufficient to create the electron avalanche chain reaction described previously which results in a plasma. However, the electric field is maintained sufficiently strong so that a corona discharge occurs. In a corona discharge, some electric charge on the electrode is dissipated through being carried through the gas to the ground as a small electric current, or through electrons being released from or absorbed into the electrodes from the ionized fuel-air mixture, but the current is very small and the voltage potential at the electrode remains very high in comparison to an arc discharge. The sufficiently strong electric field causes ionization of a portion of the fuel-air mixture to facilitate the combustion reaction(s). The ionized fuel-air mixture forms a flame front which then becomes self-sustaining and combusts the remaining fuel-air mixture.

FIG. 1 illustrates a capacitively coupled RF corona discharge ignition system. The system is termed "capacitively coupled" since the electrode 40 does not extend out of the surrounding dielectric material of the feedthru insulator 71*b* to be directly exposed to the fuel-air mixture. Rather, the electrode 40 remains shrouded by the feedthru insulator 71*b* and depends upon the electric field of the electrode passing through part of the feedthru insulator to produce the electric field in the combustion chamber 50.

FIG. 2 is a functional block diagram of the control electronics and primary coil unit 60 according to an exemplary embodiment of the invention. As shown in FIG. 2, the control electronics and primary coil unit 60 includes a center tapped primary RF transformer 20 which receives via line 62 a voltage of 150 volts, for example, from the DC source. A high power switch 72 is provided to switch the power applied to the transformer 20 between two phases, phase A and phase B at a desired frequency, e.g., the resonant frequency of the high voltage circuit 30 (see FIG. 1). The 150 volt DC source is also connected to a power supply 74 for the control circuitry in the control electronics and primary coil unit 60. The control circuitry power supply 74 typically includes a step down transformer to reduce the 150 volt DC source down to a level acceptable for control electronics, e.g., 5-12 volts. The output from the transformer 20, depicted at "A" in FIGS. 1 and 2, is used to power the high voltage circuit 30 which is housed in the secondary coil unit, according to an exemplary embodiment of the invention.

The current and voltage output from the transformer 20 are detected at point A and conventional signal conditioning is performed at 73 and 75, respectively, e.g., to remove noise from the signals. This signal conditioning may include active, passive or digital, low pass and band-pass filters, for example. The current and voltage signals are then full wave rectified and averaged at 77, 79, respectively. The averaging of the voltage and current, which removes signal noise, may be accomplished with conventional analog or digital circuits. The averaged and rectified current and voltage signals are sent to a divider 80 which calculates the actual impedance by dividing the voltage by the current. The current and voltage signals are also sent to a phase detector and phase locked loop (PLL) 78 which outputs a frequency which is the resonant frequency for the high voltage circuit 30. The PLL determines the resonant frequency by adjusting its output frequency so that the voltage and current are in phase. For series resonant circuits, when excited at resonance, voltage and current are in phase.

The calculated impedance and the resonant frequency are sent to a pulse width modulator 82 which outputs two pulse signals, phase A and phase B, each having a calculated duty cycle, to drive the transformer 20. The frequencies of the pulse signals are based on the resonant frequency received from the PLL 78. The duty cycles are based on the impedance received from the divider 80 and also on an impedance setpoint received from a system controller 84. The pulse width modulator 82 adjusts the duty cycles of the two pulse signals to cause the measured impedance from the divider 80 to match the impedance setpoint received from the system controller 84.

The system controller 84, in addition to outputting the impedance setpoint, also sends a trigger signal pulse to the pulse width modulator 82. This trigger signal pulse controls the activation timing of the transformer 20 which controls the activation of the high voltage circuit 30 and electrode 40 shown in FIG. 1. The trigger signal pulse is based on the timing signal 61 received from the master engine controller 86, not shown. The timing signal 61 determines when to start the ignition sequence. The system controller 84 receives this timing signal 61 and then sends the appropriate sequence of trigger pulses and impedance setpoint to the pulse width modulator 82. This information tells the pulse width modulator when to fire, how many times to fire, how long to fire, and the impedance setpoint. The desired corona characteristics (e.g., ignition sequence and impedance setpoint) may be hard coded in the system controller 84 or this information can be sent to the system controller 84 through signal 63 from the master engine controller 86. The system controller 84 may send diagnostics information to the master engine controller 86, as is customary in modern engine controls and ignition systems. Examples of diagnostic information may include under/over voltage supply, failure to fire as determined from the current and voltage signals, etc.

SUMMARY OF THE INVENTION AND ADVANTAGES

A power amplifier circuit that has an inductor and capacitor connected to one end of the output winding of an RF transformer. The other end of the output winding is connected to a resistor that in turn is connected to ground. The transformer has two primary windings. Both primary windings have one end connected to a variable DC voltage supply. The other end of each primary winding is attached to a MOSFET. All three windings are wound around a ferrite core. The two primary windings are arranged so that current flowing from the DC voltage supply to the MOSFET causes a magnetic flux in the ferrite core in opposing directions. To initiate oscillation of the circuit one of the MOSFETs is turned on briefly causing the inductor and capacitor to ring. As a result, a voltage is generated on the secondary winding resistor that is fed to a circuit that filters out all noise and leaves a voltage at the natural frequency of the inductor capacitor. This voltage is fed back to the MOSFETS, controlling on and off timing. In this way the need to measure and record natural frequency is eliminated.

In one embodiment of the invention, there is a power amplifier circuit for a corona ignition system, including an RF transformer with an output winding and two primary windings, the output winding and the two primary windings wound around a core; an inductor and capacitor connected to one end of the output winding; and a resistor connected to another end of the output winding, wherein current induced in the output winding generates a magnetic flux in the core in opposing directions.

In one aspect of the invention, the two primary windings each have one end connected to a variable DC voltage supply, and the other end of each of the two primary windings are attached to first and second switches, such that the first and second switches on and off timing are controlled.

In another aspect of the invention, the amplifier circuit further includes a sense winding which provides a feedback signal to compensate for varying capacitance, and wherein the output winding provides an output signal to a corona ignitor.

In another embodiment of the invention, there is a corona ignition system with a self-tuning amplifier circuit having a sensing transformer connected at one end of an output winding of an RF transformer.

In one aspect of the invention, current induced in the output winding generates a magnetic flux in the sensing transformer to excite a secondary winding.

In another aspect of the invention, ends of the secondary winding are respectively connected to two switches which drive the circuit to operating the corona ignition system, thereby igniting a corona igniter.

In yet another embodiment of the invention, there is an internal combustion engine includes a cylinder head with an ignitor opening extending from an upper surface to a combustion chamber having and a corona ignitor, including a control circuit configured to receive a signal from an engine computer; and a power amplifier circuit to generate an alternating current and voltage signal to drive an igniter assembly at its resonant frequency, the igniter assembly including an inductor, capacitor and resistor forming an LCR circuit with one end of the inductor connected through a firing end assembly to an electrode crown in the combustion chamber of the combustion engine which ignites the corona ignitor.

In one aspect of the invention, the power amplifier circuit includes an RF transformer with an output winding and two primary windings, the output winding and the two primary windings wound around a core; the inductor and capacitor connected at one end of the output winding; and the resistor connected to another end of the output winding, wherein current induced in the output winding generates a magnetic flux in the core in opposing directions.

In another aspect of the invention, the control circuit determines a voltage to apply to the power amplifier circuit, the power amplifier circuit drives current through the windings and provides a feedback signal of the resonant frequency of the igniter assembly, and the igniter assembly resonates at a specified frequency when a capacitance at the capacitor, a resistance at the resistor and an inductance at the inductor are combined.

In still another aspect of the invention, the two primary windings each have one end connected to a variable DC voltage supply, and the other end of each of the two primary windings are attached to first and second switches, such that the first and second switches on and off timing are controlled.

In yet another aspect of the invention, the amplifier circuit further includes a sense winding which provides a feedback signal to compensate for varying capacitance, and wherein the output winding provides an output signal to the corona ignitor.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

A power amplifier circuit that has an inductor and capacitor connected to one end of the output winding of an RF transformer. The other end of the output winding is connected to a resistor that in turn is connected to ground. The transformer has two primary windings. Both primary windings have one end connected to a variable DC voltage supply. The other end of each primary winding is attached to a MOSFET. All three windings are wound around a ferrite core. The two primary windings are arranged so that current flowing from the DC voltage supply to the MOSFET causes a magnetic flux in the ferrite core in opposing directions. To initiate oscillation of the circuit one of the MOSFETs is turned on briefly causing the inductor and capacitor to ring. As a result, a voltage is generated on the secondary winding resistor that is fed to a circuit that filters out all noise and leaves a voltage at the natural frequency of the inductor capacitor. This voltage is fed back to the MOSFETs, controlling on and off timing. In this way the need to measure and record natural frequency is eliminated.

Figure 1:
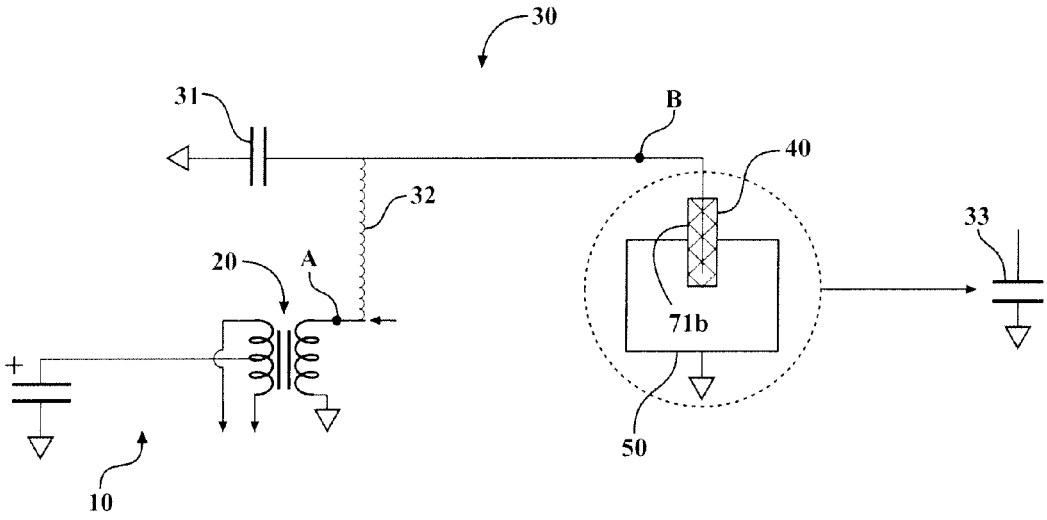
FIG. 1 Prior Art
FIG. 1 illustrates an exemplary corona discharge ignition system in the prior art.
Figure 2:
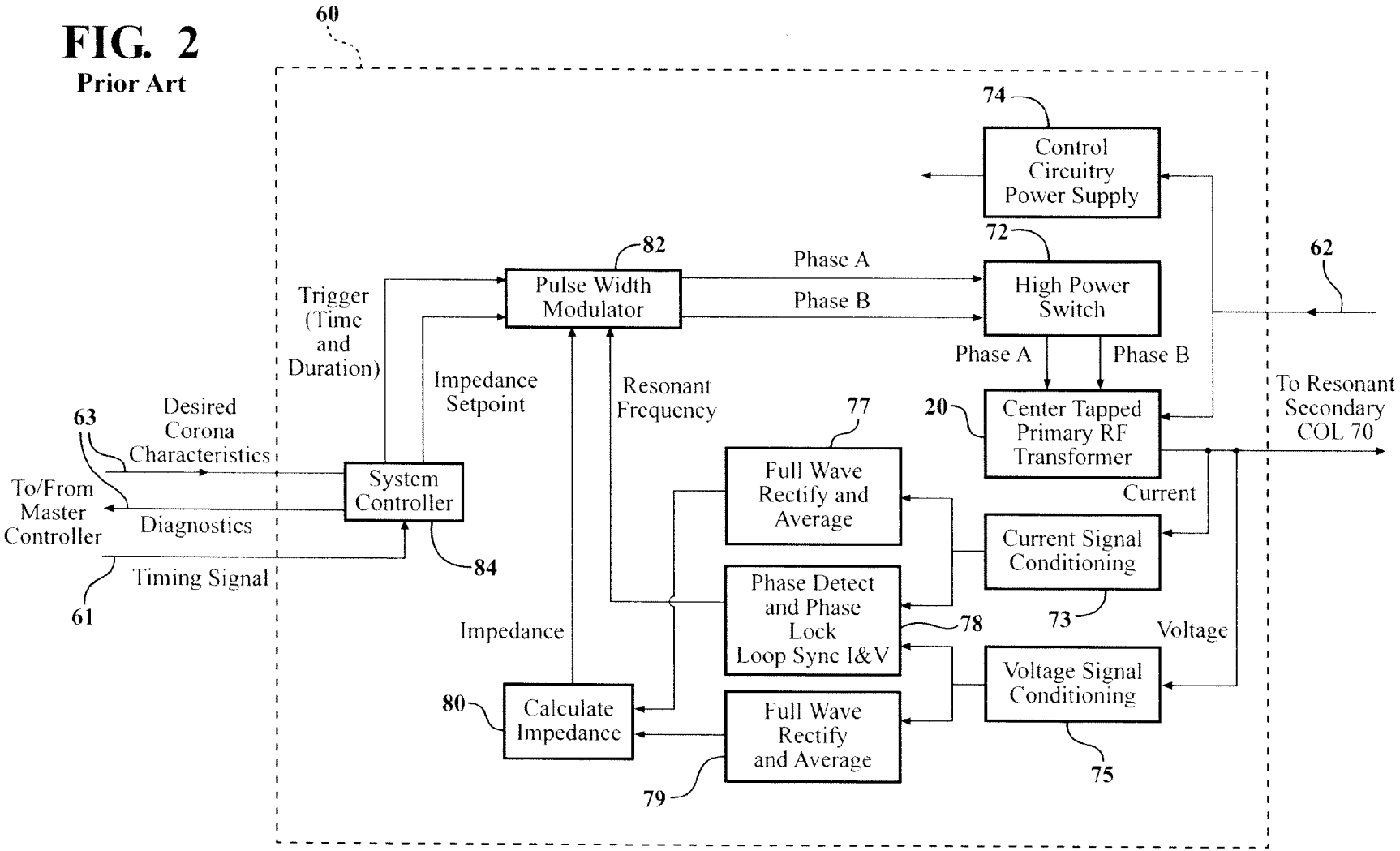
FIG. 2 Prior Art
FIG. 2 shows a functional block diagram of the control electronics and primary coil unit in accordance with the prior art system.
Figure 3:
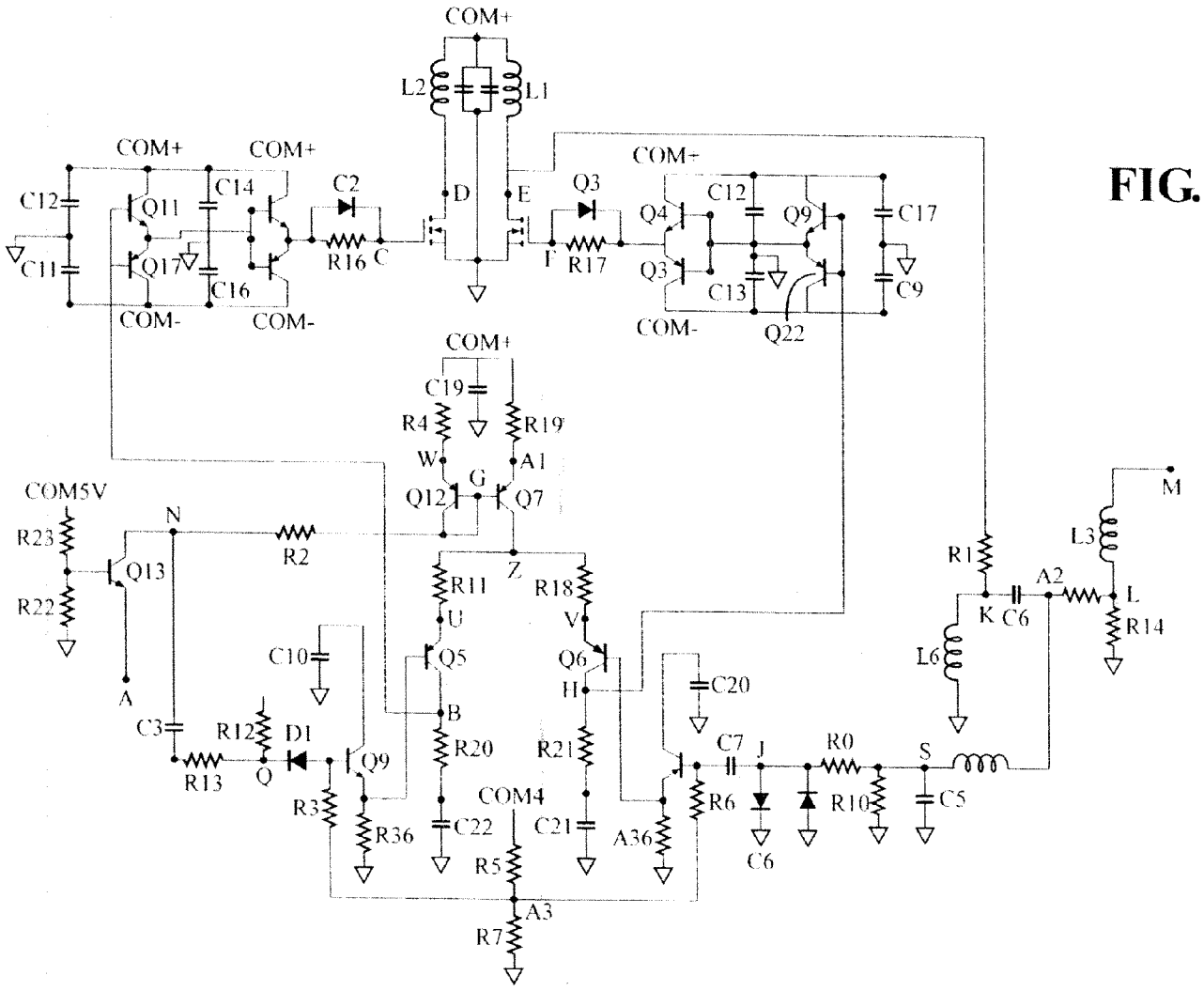
FIG. 3 illustrates a self-tuning circuit in accordance with the invention.

The circuit illustrated in FIG. 3 includes a transformer, mosfets to drive the transformer, and a feedback circuit to tune the frequency of operation of the transformer. The transformer has, in one example, a ferrite core with four sets of windings around the core. Inductors L1 and L2 are the primary windings, which are joined together at a point that is connected to a DC voltage supply. The circuit can be designed to operate with a range of voltage supply voltages, in this embodiment the voltage will be set to 60VDC. The other ends of inductors L1 and L2 are each connected to a switch, which is shown as a MOSFET. Other types of switches may be used, as readily understood by the skilled artisan.

Inductor L3 is the secondary or output inductor of the transformer. One end of L3 is connected through a low value resistance. The other end is connected to the inductor of a corona igniter. The fourth inductor, L6, is a sense inductor which provides a feedback signal to compensate for the varying capacitance of different length attachment cables.

The ignition system is comprised of three sub-assemblies: a control circuit, a power amplifier and an igniter assembly.

Control circuit: This circuit receives a signal from the engine computer (ECU) that tells the system when to start and end corona in the cylinder. This circuit determines what voltage to apply to the power amplifier transformer. Part of this circuit generates the DC voltage that is applied to the power amplifier transformer.

Power amplifier circuit: This circuit generates an alternating current and voltage signal to drive the igniter assembly at its resonant frequency. It receives a command from the control circuit to begin and end oscillation. The power amplifier circuit includes circuits to drive current through a transformer and a circuit to feed back the resonant frequency of the igniter assembly. This feedback signal includes a signal related to inductor resonance, a signal related to primary winding voltage, and a feedback signal related to the secondary winding voltage.

Igniter assembly: The igniter assembly attaches to the cylinder head in a manner similar to a spark plug. The assembly includes an inductor and a firing end subassembly which includes an electrode inside the combustion chamber. The igniter assembly has an inductor, capacitor and resistor wired together as an LCR assembly. When a voltage is applied to one end of the inductor the LCR assembly resonates. The inductor is part of the igniter. The second end of the inductor is connected through a firing end assembly to an electrode crown in the combustion chamber. The firing end assembly and the combustion chamber form a capacitance and resistance that when combined with the inductance resonate at a specific frequency.

In operation, a device such as the engine computer (ECU) sends a signal to the control circuit. This signal tells the control circuit when to start and end corona on each igniter. The control circuit sends a normally high signal to the power amplifier that goes low to start the corona event. The signal stays low for as long as corona is desired, and returns high to end the corona event. This signal is applied to node A which is the emitter of Q13. This change in the voltage at A causes node N to go from high to low. Node N is then sent to two places.

One destination is the collector of Q12 and the bases of Q12 and Q7. This drop at N causes Q12 and Q7 to turn on, allowing current to flow to node Z. The second destination is C3, which sends a brief voltage drop through R13 and diode 1 to node R, the base of Q9. This in turn briefly drops the voltage at node T. This dip in the base turns Q5 on, drawing current from node Z, and raising node B from negative to positive. This turns Q11 on and Q17 off, which causes Q1 to turn on and Q2 to turn off. This pulls their emitters up, which are connected through R16 and diode 2 to node C, the gate of M1. Node C goes from negative to positive, turning M1 on. The drain of M1 is connected to L2, and its source is connected to ground. Turning on M1 causes current to flow through L2, which in turn induces a magnetic flux to flow through the ferrite inside the transformer.

As M1 continues to stay on, current is conducted through L2, until the voltage at node T returns to a value that shuts Q5 off. This causes the current flowing through node Z to transfer from R11 into R18, raising node H from negative to positive. This turns Q8 on and Q20 off which causes Q4 to turn on and Q3 to turn off. This pulls their emitters up, which are connected through R17 and diode 3 to node F, the gate of M4. Node F goes from negative to positive, turning M4 on. Turning on M4 causes current to flow through L1, which in turn induces a magnetic flux to flow in the opposite direction to the flux caused by L2, through the ferrite inside the transformer.

The transformer ferrite magnetic flux generates a current through the transformer secondary winding L3 that in turn creates a voltage across its two ends. One end of L3 is connected to R14 which is attached to ground. The other end of L3 is attached to the inductor in the igniter assembly. The rapidly changing voltage applied to the igniter LCR assembly induces it to resonate. When current flows through R14 the voltage at node L rises. This voltage is fed through R15 into node A2. The current from node A2 goes through L5, which is connected to C5 and R19. These components form a band gap filter, and remove frequencies outside the range of interest. This signal is clipped by D7 and D8, and then passed through C7 to drive Q10. When Q10 is turned on, current flows through R18 and stops flowing through R11. This switches M1 off and M4 on, and vice versa.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A power amplifier circuit for a corona ignition system, comprising:

an RF transformer with an output winding and two primary windings, the output winding and the two primary windings wound around a core;

an inductor and capacitor connected to one end of the output winding; and a resistor connected to another end of the output winding, wherein current induced in the output winding generates a magnetic flux in the core in opposing directions.

2. The power amplifier of claim 1, wherein the two primary windings each have one end connected to a variable DC voltage supply, and the other end of each of the two primary windings are attached to first and second switches, such that the first and second switches on and off timing are controlled.

3. The power amplifier of claim 2, further comprising a sense winding which provides a feedback signal to compensate for varying capacitance, and wherein the output winding provides an output signal to a corona ignitor.

4. An internal combustion engine includes a cylinder head with an ignitor opening extending from an upper surface to a combustion chamber having and a corona ignitor, comprising: a control circuit configured to receive a signal from an engine computer; and a power amplifier circuit to generate an alternating current and voltage signal to drive an igniter assembly at its resonant frequency, the igniter assembly including an inductor, capacitor and resistor forming an LCR circuit with one end of the inductor connected through a firing end assembly to an electrode crown in the combustion chamber of the combustion engine which ignites the corona ignitor, wherein the power amplifier circuit comprises:

an RF transformer with an output winding and two primary windings, the output winding and the two primary windings wound around a core;

the inductor and capacitor connected at one end of the output winding; and the resistor connected to another end of the output winding, wherein current induced in the output winding generates a magnetic flux in the core in opposing directions.

5. The internal combustion engine of claim 4, wherein the control circuit determines a voltage to apply to the power amplifier circuit, the power amplifier circuit drives current through the windings and provides a feedback signal of the resonant frequency of the igniter assembly, and the igniter assembly resonates at a specified frequency when a capacitance at the capacitor, a resistance at the resistor and an inductance at the inductor are combined.

6. The internal combustion engine of claim 5, wherein the two primary windings each have one end connected to a variable DC voltage supply, and the other end of each of the two primary windings are attached to first and second switches, such that the first and second switches on and off timing are controlled.

7. The power amplifier of claim 6, further comprising a sense winding which provides a feedback signal to compensate for varying capacitance, and wherein the output winding provides an output signal to the corona ignitor.

* * * * *

UNITED STATES PATENT AND TRADEMARK OFFICE

CERTIFICATE OF CORRECTION

PATENT NO. : 8,578,902 B2
APPLICATION NO. : 12/777105
DATED : November 12, 2013
INVENTOR(S) : Hampton et al.

It is certified that error appears in the above-identified patent and that said Letters Patent is hereby corrected as shown below:

Title Page, Item (12) delete "Permuy" and insert -- Hampton --.

Title Page, Item (75) Inventors: first inventor should read -- Keith Hampton --.

In the Specification

Column 1, Line 10 the word "which" should be deleted.

Signed and Sealed this
Twenty-eighth Day of January, 2014

Michelle K. Lee

Michelle K. Lee
*Deputy Director of the United States Patent and Trademark Office*